US008650833B1

(12) United States Patent
Polston

(10) Patent No.: US 8,650,833 B1
(45) **Date of Patent: *Feb. 18, 2014**

(54) METHOD FOR INSTALLING A ROOF VENT

(71) Applicant: Ross Manufacturing, LLC, New Braunfels, TX (US)

(72) Inventor: Barry Ross Polston, New Braunfels, TX (US)

(73) Assignee: Ross Manufacturing, LLC, New Braunfels, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/916,906

(22) Filed: Jun. 13, 2013

(51) Int. Cl.
*E04B 1/00* (2006.01)
*E04G 21/00* (2006.01)
*E04G 23/00* (2006.01)

(52) U.S. Cl.
USPC ..... 52/745.16; 52/95; 52/97; 52/60; 52/199; 52/200; 454/250; 454/367; 454/275

(58) Field of Classification Search
USPC ..... 52/95, 97, 302.7, 218, 219, 58, 60, 198, 52/200, 199; 454/250, 367, 359, 275; 181/224; 285/42
See application file for complete search history.

(56) References Cited

U.S. PATENT DOCUMENTS

| | | | | | |
|---|---|---|---|---|---|
| 3,110,357 | A | * | 11/1963 | Jenn et al. | 181/224 |
| 3,749,908 | A | * | 7/1973 | Esser et al. | 52/574 |
| 3,934,383 | A | | 1/1976 | Perry et al. | |
| 4,652,321 | A | * | 3/1987 | Greko | 156/165 |
| 5,018,333 | A | * | 5/1991 | Bruhm | 52/741.4 |
| 5,094,054 | A | * | 3/1992 | Arends | 52/95 |
| 5,434,780 | A | * | 7/1995 | Kume et al. | 701/65 |
| 5,535,558 | A | | 7/1996 | Rieke et al. | |
| 5,662,522 | A | | 9/1997 | Waltz | |
| 5,675,940 | A | * | 10/1997 | Bahar et al. | 52/58 |
| 5,687,514 | A | * | 11/1997 | Gillispie | 52/58 |
| 5,806,255 | A | * | 9/1998 | Verby et al. | 52/200 |
| 6,155,008 | A | | 12/2000 | McKee | |
| 6,308,480 | B1 | * | 10/2001 | Haney | 52/302.6 |
| 6,767,281 | B2 | | 7/2004 | McKee | |
| 6,904,725 | B1 | * | 6/2005 | Hansen et al. | 52/200 |
| 7,721,493 | B2 | * | 5/2010 | Skov et al. | 52/200 |
| 7,748,174 | B2 | * | 7/2010 | Bonshor | 52/97 |
| 7,780,510 | B2 | | 8/2010 | Polston | |
| 2009/0053990 | A1 | | 2/2009 | McKee | |
| 2013/0078903 | A1 | | 3/2013 | Mantyla et al. | |

* cited by examiner

*Primary Examiner* — Chi Q Nguyen
(74) *Attorney, Agent, or Firm* — Eric Karich

(57) ABSTRACT

A method for installing a roof vent includes the steps of providing a base component having an outer flange having a bottom surface and surrounding a central opening; providing a top cover; mounting the top cover on the base component over the central opening to permit the air to flow through the central opening, but to exclude water from entering the central opening; and welding a riser box on the bottom surface of the base component around the central opening, the riser box being sized and shaped to fit around the curb of the roof. The base component is then mounted onto the curb such that the base component covers the building venting aperture and the riser box fits around the curb.

1 Claim, 4 Drawing Sheets

METHOD FOR INSTALLING A ROOF VENT

BACKGROUND OF THE INVENTION

1. Field of the Invention

This invention relates generally to roof vents, and more particularly to a method for installing a plastic roof vent on a roof having a curb.

2. Description of Related Art

The prior art teaches a wide range of roof vents for ventilating buildings.

Polston, U.S. Pat. No. 7,780,510, teaches an attic vent that is adapted for use on a roof of a residential building for venting an attic. The vent includes a generally planar base member that is suited for mounting on a sloped roof of a residence. The base component is covered by a top cover to prevent rain from penetrating the roof. While well suited for the sloped roof of an ordinary home, this vent can't be installed in commercial buildings because the planar base member is not suited for this purpose.

McKee, U.S. Pat. No. 6,155,008, teaches a similar venting device that includes a base member having a vent structure therein. The device also includes a cap member that is positioned over the vent structure to exclude precipitation from the structure. This venting device is also not suited for commercial buildings. The above-described references are hereby incorporated by reference in full.

The prior art teaches roof vents that include a planar base member suitable for residential use. However, the prior art does not teach a plastic residential roof vent that includes a plastic riser box that enables the vent to be used on a commercial rooftop that includes a curb around a building vent. The present invention fulfills these needs and provides further advantages as described in the following summary.

SUMMARY OF THE INVENTION

The present invention teaches certain benefits in construction and use which give rise to the objectives described below.

The present invention provides a method for covering a building venting aperture of a roof to allow air to flow therethrough. The method comprises the steps of providing a base component having an outer flange having a bottom surface and surrounding a central opening; providing a top cover; mounting the top cover on the base component over the central opening to permit the air to flow through the central opening, but to exclude water from entering the central opening; and welding a riser box on the bottom surface of the base component around the central opening, the riser box being sized and shaped to fit around the curb of the roof. The base component is then mounted onto the curb such that the base component covers the building venting aperture and the riser box fits around the curb.

A primary objective of the present invention is to provide a method for installing a roof vent, the method having advantages not taught by the prior art.

Another objective is to provide a method for installing a roof vent that includes welding a riser box onto the roof vent to enable the roof vent to be used on a commercial rooftop that includes a curb around the building venting aperture.

Another objective is to provide a roof vent that includes energy directing ridges on a bottom surface of the base component for facilitating sonic welding of the riser box onto the base component. If the sonic welding is not utilized than the ridges will act as a block to prevent water from penetrating between the riser box and the base component.

A further objective is to provide a roof vent that is easier and less expensive to install, and does not require any customized metal fabrication at the point of installation.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a roof vent 10 for mounting on a roof 12 having a curb 14, to allow airflow from a building venting aperture 16 in the roof 12.

Figure 1:
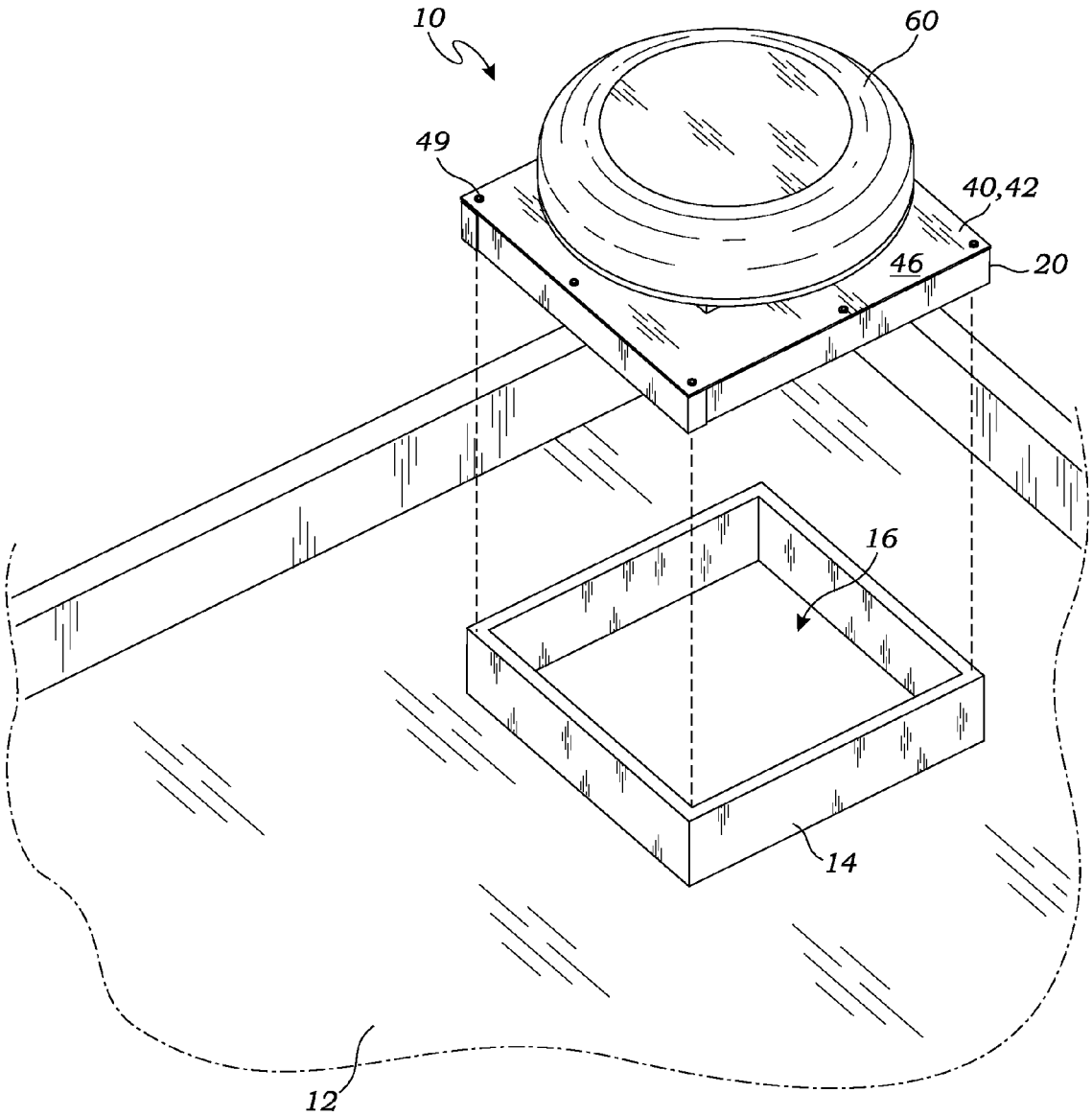
FIG. 1 is a perspective view of a roof vent according to one embodiment of the present invention, the roof vent being positioned on a roof having a curb for installation.

FIG. 1 is a perspective view of the roof vent 10 according to one embodiment of the present invention. As illustrated in FIG. 1, the roof vent 10 is positioned on the roof 12 for installation over and around the curb 14 of the roof 12. The roof vent 10 includes a base component 40 with a top cover 60 mounted thereupon to exclude water from the building venting aperture 16 of the roof 12. A riser box 20 mounted on the base component 40 fits over and around the curb 14 for secure mounting and to exclude water.

Figure 2:
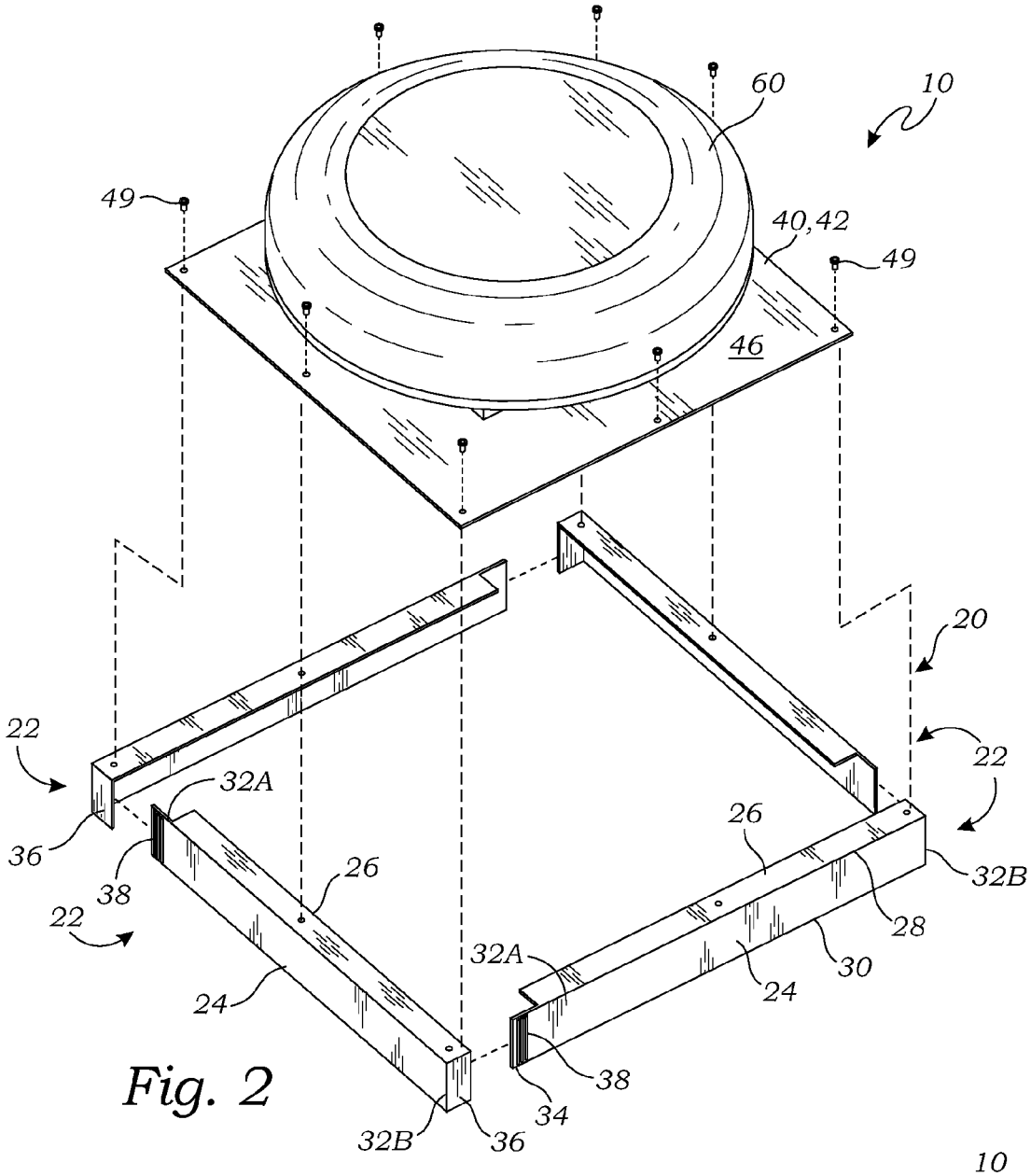
FIG. 2 is an exploded perspective view of the roof vent.

FIG. 2 is an exploded perspective view of the roof vent 10, illustrating the construction of one embodiment of the riser box 20. As illustrated in FIG. 2, the riser box 20 of this embodiment includes four wall elements 22, although other arrangements may be utilized by one skilled in the art. Each of the wall elements 22 may comprise a rectangular body 24 and may include a top flange 26. As used in this application, the term "rectangular" is defined to include rectangular and equivalent shapes that are suitable for forming a suitable riser box for mounting on the curb 14.

Figure 7:
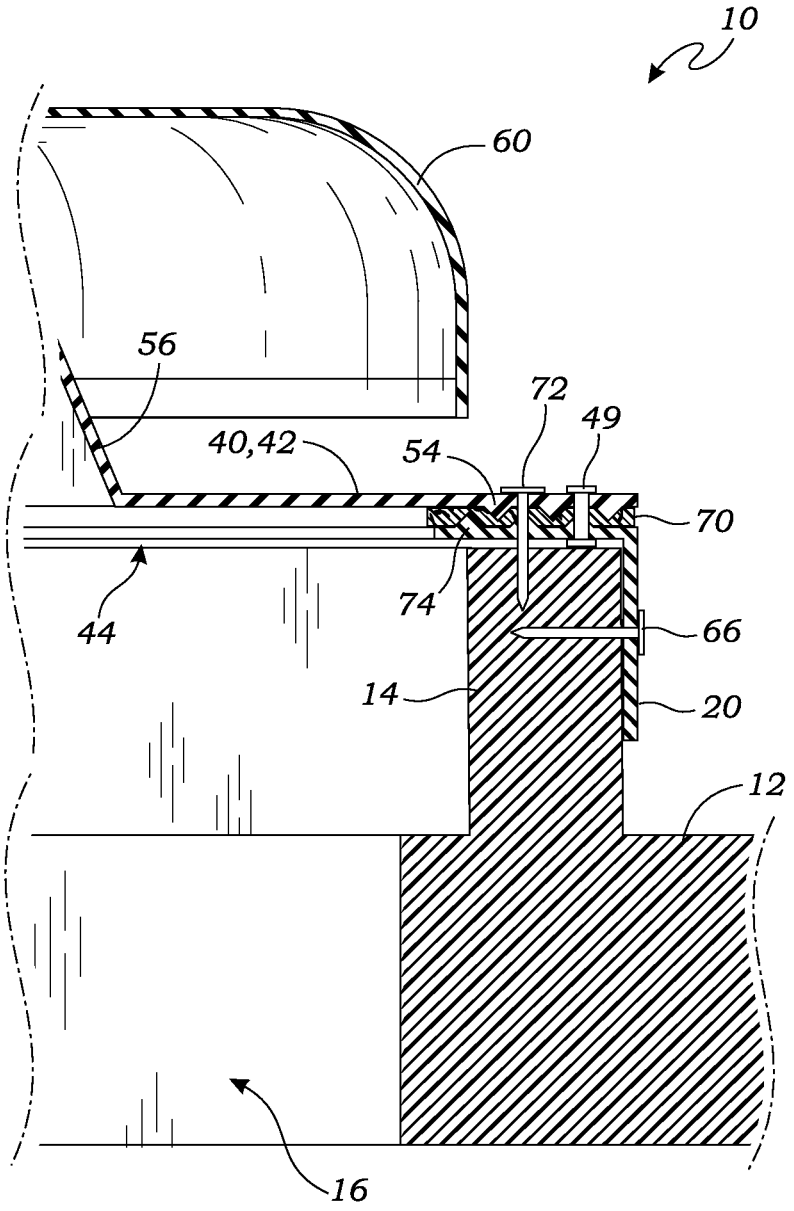
FIG. 7 is a sectional view similar to FIG. 4, illustrating a portion of the roof vent once it has been installed on the curb.

In this embodiment, the rectangular body 24 includes a top edge 28, a bottom edge 30, and side edges 32A and 32B. The top flange 26 may extend from the top edge 28 generally perpendicular to the rectangular body 24. The top flange 26 may be attached to the bottom surface 48 (illustrated in FIG. 5) of the base component 40 of the roof vent 10. The top flange 26 may be attached to the base component 40 via welding (e.g., sonic welding), and/or with rivets 49, an adhesive layer 70, and/or in any method known in the art. An embodiment that illustrates the use of the rivets 49 and the adhesives 70 is illustrated in FIG. 7, and discussed in greater detail below. For purposes of this application, geometric terms such as perpendicular are hereby defined to include equivalent configurations, and should not be construed to require precision in geometry, but should be broadly construed. For example, perpendicular should be construed to include angles that are not precisely 90 degrees, but that are functionally equivalent.

In the embodiment of FIG. 2, each of the wall elements 22 may further include a side flange 34 extending from one of the side edges 32A beyond the top flange 26. The side flange 34 is adapted to be welded to the side edge 32B of an adjacent wall element 22 for forming the riser box 20. The wall element 22 may also include an end cap 36 that extends from the side edge 32B perpendicular to the rectangular body 24. In this embodiment, the side flange 34 includes one or more energy directing ridges 38 for sonic welding the end cap 36 to the adjacent wall element 22.

Figure 3:
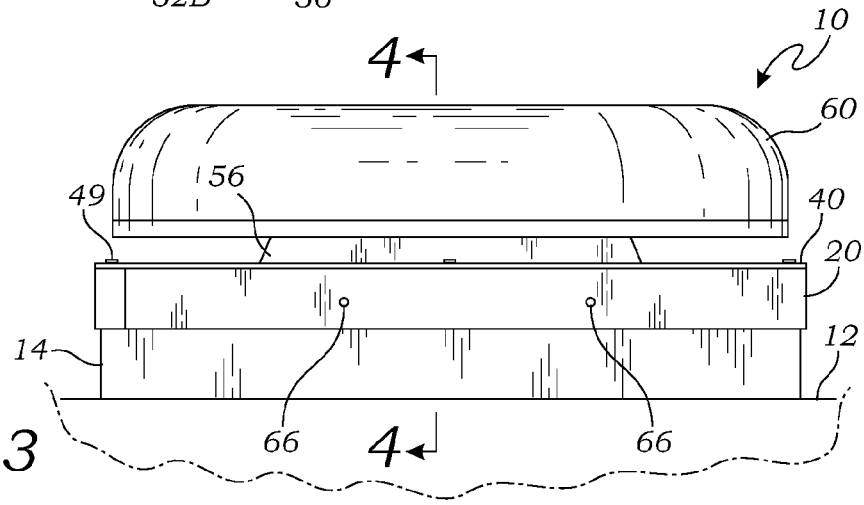
FIG. 3 is a side elevational view of the roof vent of FIG. 1.
Figure 4:
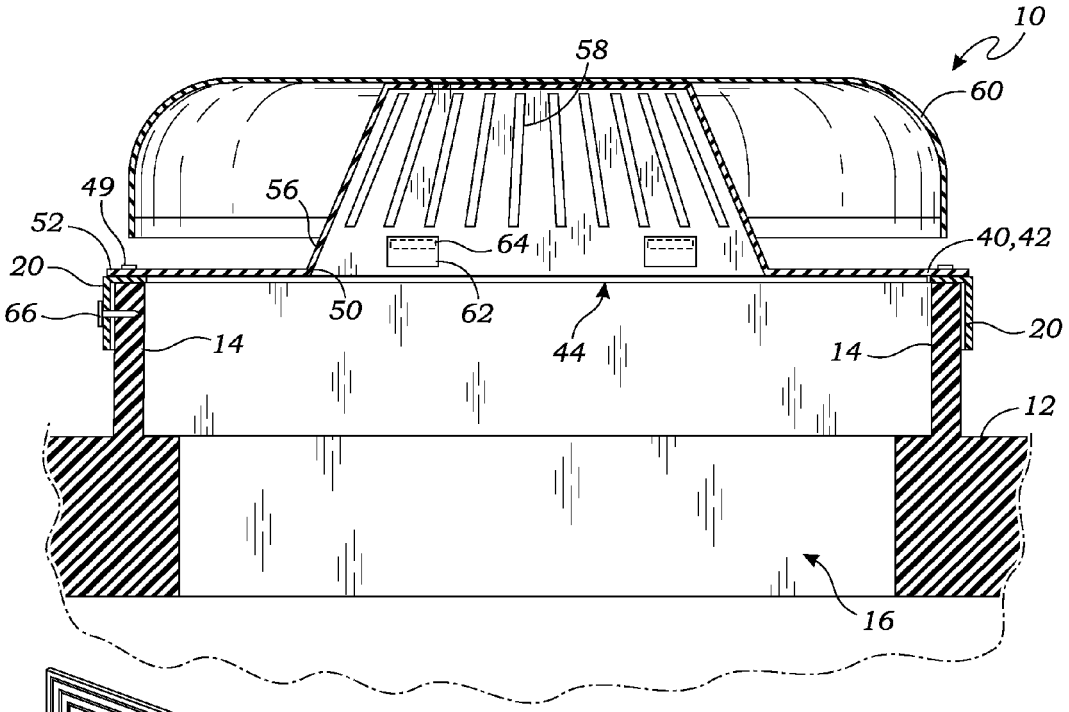
FIG. 4 is a sectional view thereof taken along line 4-4 in FIG. 3.

FIG. 3 is a side elevational view of the roof vent 10 of FIG. 1. FIG. 4 is a sectional view thereof taken along line 4-4 in FIG. 3. As illustrated in FIGS. 2-4, the base component 40 includes an outer flange 42 surrounding a central opening 44. The base component 40 is made of plastic and has a top surface 46, a bottom surface 48 (illustrated in FIG. 5), an inner perimeter 50 that defines the central opening 44, and an outer perimeter 52. The central opening 44 may include an upwardly extending wall 56 for excluding water, and a grill 58 covering the central opening 44 to exclude entry through the central opening 44 of debris, animals, etc., while still enabling air to circulate through the central opening 44.

The top cover 60 is mounted on the base component 40 over the central opening 44 to permit the air to flow through the building venting aperture 16, but to exclude water from entering the building venting aperture 16. The top cover 60 may be dome-shaped, as illustrated, or in another shape suitable for the application. While one embodiment of the base component 40 and the top cover 60 is illustrated, alternative shapes and constructions may also be utilized, and such alternatives should be considered within the scope of the present invention.

The top cover 60 may be fastened to the base component 40 in any manner known in the art, in this case with locking elements 62 of the top cover 60 that engage receivers 64 of the base component 40. Other engagement mechanisms or methods may also be used to directly or indirectly fasten the top cover 60 to the base component 40, and such alternatives should be considered within the scope of the present invention.

Figure 5:
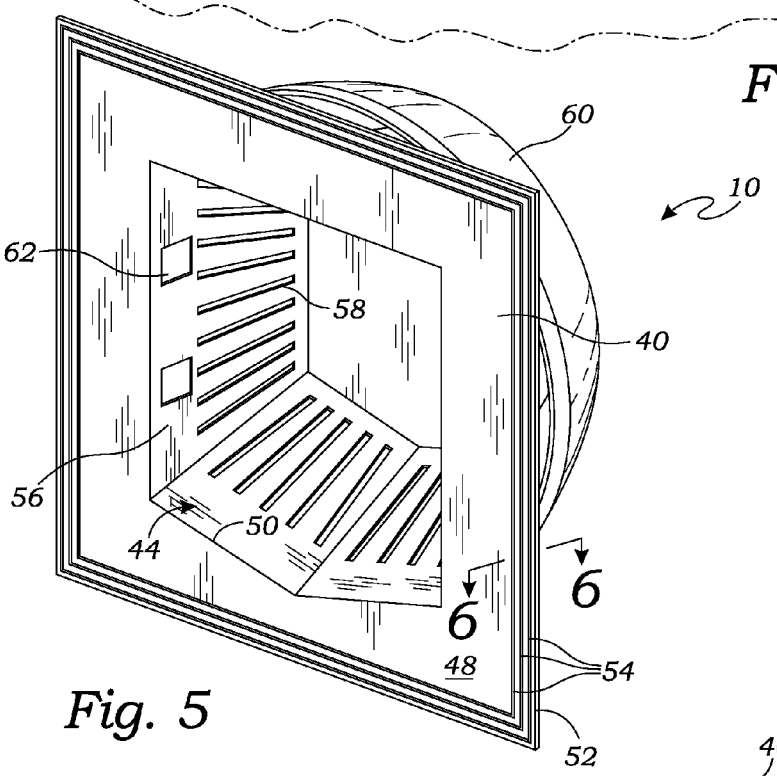
FIG. 5 is a bottom perspective view of the roof vent of FIG. 1.
Figure 6:
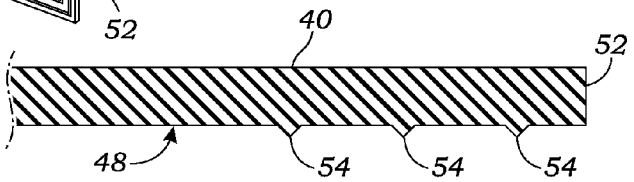
FIG. 6 is a sectional view thereof taken along line 6-6 in FIG. 5.

FIG. 5 is a bottom perspective view of the roof vent 10 of FIG. 1. FIG. 6 is a sectional view thereof taken along line 6-6 in FIG. 5. As illustrated in FIGS. 5 and 6, the bottom surface 48 of the base component 40 includes energy directing ridges 54 for sonic welding the riser box 20 onto the base component 40, as discussed in greater detail below.

As illustrated in FIGS. 5 and 6, in this embodiment the energy directing ridges 54 are linear in configuration that that have a generally triangular cross-section. In this embodiment, the apex of the triangular cross-section of the energy directing ridges 54 has an angle of about 50-100 degrees, in this case about 60 degrees, although this can vary depending upon the particular product design.

The term "energy directing ridges" is hereby defined to include one or more ridges that are suitable for sonic welding two components together, as known to those skilled in the art. In this embodiment, the bottom surface includes a plurality of these ridges, and they are linear in configuration, although other configurations may be utilized. For purposes of this application, the term energy directing ridges is further defined to include similar and/or equivalent structures that function to focus sonic energy so that they tend to melt during sonic welding and facilitate fusion of the adjacent parts. The term "triangular" is likewise defined to include similar and/or equivalent shapes, and is meant to be broadly construed to encompass equivalent structures according to the knowledge of one skilled in the art. For purposes of this application, the term "about" is hereby defined to mean+/−8%.

The roof vent 10 may be assembled using welding, such as sonic welding, and/or other methods known in the art (e.g., adhesives, rivets, and other forms of fasteners, etc.), and installed on the roof 12, as illustrated in FIGS. 1-6. As illustrated in FIG. 2, the side edge 32A, such as the side flange 34 of each of the wall elements 22 is sonic welded to the side edge 32B, in this case to the end cap 36 of the adjacent wall element 22, preferably using the energy directing ridges 38 of the side flange 34, to form the riser box 20. The top flanges 26 of the wall elements 22 are then sonic welded to the bottom surface 48 of the base component 40, preferably using the energy directing ridges 54 of the bottom surface 48 of the base component 40. The additional wall elements 22 may also be added in a similar manner.

In addition to this process, any other method of assembly may be used, according to the knowledge of one skilled in the art.

As illustrated in FIGS. 1 and 4, the roof vent 10, with the riser box 20 installed, may then be mounted on the roof 12 over the curb 14. The riser box 20 and/or the roof vent 10 may then be fastened in place, such as with nails 66 (illustrated in FIG. 4) through the roof vent 10 and/or riser box 20 into the curb 14 or other suitable structure. Other fasteners may also be used, and/or any other mechanism for securing the roof vent 10, according to the knowledge of one skilled in the art.

FIG. 7 is a sectional view similar to FIG. 4, illustrating a portion of the roof vent 10 once it has been installed on the curb 14. As illustrated in FIG. 7, the base component 40 may be attached to the riser box 20 with the rivets 49 and the adhesive layer 70 mentioned above. Additional nails 72 may be driven through the riser box 20, the base component 40, and into the curb 14. In this embodiment, additional energy directing ridges 74 may be included in the top flange of the riser box 20. If the sonic welding is not utilized than the ridges 74 will act as a block to prevent water from penetrating between the riser box 20 and the base component 40.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A method for covering a building venting aperture of a roof to allow air to flow therethrough, the roof having a curb around the building venting aperture, the method comprising the steps of:

providing a base component having a bottom surface and a central opening;

providing a top cover;

mounting the top cover on the base component over the central opening to permit the air to flow through the central opening, but to exclude water from entering the central opening;

providing four wall elements, each of the wall elements comprising:

a rectangular body having a top edge, a bottom edge, and side edges;

a top flange extending from the top edge generally perpendicular to the rectangular body; and an end cap extending from one of the side edges perpendicular to both the top flange and the rectangular body;

welding the side edges of each of the four wall elements to the end cap of the adjacent wall element, and welding the top flanges of the four wall elements to the bottom surface of the base component, to form a riser box mounted on the bottom surface of the base component; and mounting the base component onto the curb such that the base component covers the building venting aperture and the riser box fits around the curb.

* * * * *